US005599423A

United States Patent [19]

Parker et al.

[11] Patent Number: 5,599,423

[45] Date of Patent: Feb. 4, 1997

[54] APPARATUS AND METHOD FOR SIMULATING AND OPTIMIZING A CHEMICAL MECHANICAL POLISHING SYSTEM

[75] Inventors: Norman W. Parker, Fairfield; Robert D. Tolles, Santa Clara; Harry Q. Lee, Mountain View, all of Calif.

[73] Assignee: Applied Materials, Inc., Santa Clara, Calif.

[21] Appl. No.: 497,362

[22] Filed: Jun. 30, 1995

[51] Int. Cl.[6] ..... H01L 21/00

[52] U.S. Cl. ..... 156/636.1; 156/637.1; 156/345; 216/88; 437/225

[58] Field of Search ..... 156/636.1, 637.1, 156/639.1, 645.1, 657.1, 662.1, 345 LP; 216/38, 52, 53, 88, 91; 437/225, 228 POL, 228

[56] References Cited

U.S. PATENT DOCUMENTS 4,793,895 12/1988 Kaanta et al. ..... 156/636.1 X
4,940,507 7/1990 Harbarger ..... 156/345 LP
5,474,644 12/1995 Kato et al. ..... 156/345 L
5,514,245 5/1996 Doan et al. ..... 156/636.1

*Primary Examiner*—William Powell
*Attorney, Agent, or Firm*— Thomason & Moser

[57] ABSTRACT

Apparatus and concomitant method for simulating a chemical mechanical polishing (CMP) system containing a polishing pad, a chuck for supporting a substrate, a positioner for positioning the polishing pad with respect to the substrate, a chuck rotator for rotating the chuck, and a polishing pad rotator for rotating the polishing pad. The CMP system simulation method comprises: defining polishing pad and substrate parameters; defining simulation parameters; determining, in response to said polishing pad, substrate and simulation parameters, a polishing result; and displaying the polishing result. Additionally, the simulation optimizes selected parameters to achieve a specified polishing non-uniformity across a substrate. Also, the simulation and optimization routines are interfaced to CMP system hardware to optimally control a substrate polishing process to achieve predetermined substrate polishing non-uniformity.

29 Claims, 11 Drawing Sheets

APPARATUS AND METHOD FOR SIMULATING AND OPTIMIZING A CHEMICAL MECHANICAL POLISHING SYSTEM

BACKGROUND OF THE DISCLOSURE

1. Field of the Invention

The invention relates to the field of chemical mechanical polishing. More particularly, the invention relates to methods and apparatus for simulating and optimizing chemical mechanical polishing systems for polishing substrates used in the manufacture of integrated circuits.

2. Description of the Background Art

Chemical mechanical polishing is a method of planarizing or polishing semiconductor and other types of substrates. For example, at certain stages in the fabrication of devices on a substrate, it may become necessary to polish the surface of the substrate before further processing may be performed. One polishing process, known as mechanical polishing, repetitively passes a conformable polishing pad over the surface of the substrate. Mechanical polishing may also be performed with a chemically active abrasive slurry. A polishing system that uses a chemical slurry is commonly known as a chemical mechanical polishing (CMP) system. In contrast with mechanical polishing, the slurry in a CMP system provides an increased removal rate of substrate material. Additionally, by selecting particular chemicals as the slurry, a chemical slurry can be used to selectively polish certain films comprising a semiconductor substrate.

One type of CMP system is disclosed in U.S. Pat. No. 5,234,867, issued on Aug. 10, 1993 and incorporated herein by reference. The polishing process disclosed therein includes the steps of rotating a polishing pad that has a diameter several times larger than a substrate, pouring a chemical slurry on the rotating polishing pad, and placing a substrate against the rotating polishing pad. Because the polishing pad is larger than the substrate, this type of CMP system is known as a "large pad" system. To uniformly polish the substrate, the substrate is independently rotated while the system maintains pressure between the rotating polishing pad and the rotating substrate. The polishing pad is supported on a relatively massive platen that is coupled to a motor that rotates the platen and the pad. To independently rotate the substrate, the substrate is located within a separate rotating head or chuck whose rotational axis is parallel to the axis of rotation of the polishing pad. To facilitate substantially uniform polishing, the distance between the polishing pad rotational axis and the substrate rotational axis is varied in an oscillatory manner. As such, the system positions the polishing head at various radii of the polishing pad. Typically, the substrate is repeatedly moved, relative to the large polishing pad, from the outer diameter of the pad to the center of the pad and vice versa, i.e., an oscillatory motion.

Other examples of large pad polishing systems are disclosed in U.S. Pat. Nos. 5,232,875, issued Aug. 3, 1993; 5,285,795, issued Sep. 21, 1993; and 4,600,465, issued Jul. 15, 1986.

A second type of CMP system is disclosed in U.S. patent application Ser. No. 08/153,331, filed Nov. 16, 1993, entitled "Substrate Polishing Apparatus" and incorporated herein by reference. This CMP process polishes a substrate using a polishing pad that is smaller than the diameter of the substrate. As such, this type of CMP system is known as a "small pad" system. The small pad system contains a rotating plate on which a substrate is held and a polishing arm that is located above the surface of the plate. One end of the polishing arm supports a polishing pad and the arm moves the pad radially relative to the rotating substrate. The polishing arm variably controls the pressure at which the polishing pad contacts the surface of the substrate. Additionally, to further control the polishing process, the rotation rate of the substrate is variably controlled.

Because both types of CMP systems provide substantial flexibility in selecting parameters (variables) to control the polishing process, the manner in which parameters are selected and optimized can be overwhelming. Determination of the variables for polishing a particular substrate in a particular manner typically is accomplished by estimation coupled with trial and error testing on a number of substrates. Such trial and error testing can consume an inordinate amount of time and materials before an appropriate combination of variables is found. Presently, there are no apparatus or methods available for simulating a CMP system to determine the variables necessary to provide a particular polishing characteristic. Additionally, there are no methods or apparatus for optimizing variable values to achieve a particular polishing characteristic within a minimal amount of polishing time.

Therefore, a need exists in the art for apparatus and methods of simulating and optimizing polishing parameters for both large and small pad CMP polishing systems.

SUMMARY OF THE INVENTION

The present invention overcomes the disadvantages heretofore associated with prior art CMP polishing systems. In particular, the invention is a simulator (including both apparatus and a concomitant method) for simulating both large and small pad CMP systems. In general, the simulated CMP system comprises a polishing pad, a chuck for supporting a substrate, a positioner for positioning the polishing pad relative to the substrate (or vice versa), a chuck rotator for rotating the chuck, and a polishing pad rotator for rotating the polishing pad. The CMP system simulator is implemented as a computer program that is executed on a general purpose computer system. The simulator enables a user to enter particular simulation parameters that define polishing pad size and shape, substrate size, polishing pad dwell time at particular locations on the substrate, pad aging, pad to substrate pressure, rotational velocity of the pad relative to the substrate, and a number of passes of the pad over the substrate or, in a large pad system, the number of passes of the substrate over the pad. From these parameters, the simulator calculates polishing results that indicate the amount of substrate material removed during polishing of the substrate.

Additionally, an optimizer is provided that repetitively executes the simulation with a view towards optimizing one or more of the parameters until the simulation attains a specific criterion. The criterion is typically a specified polishing non-uniformity across the substrate surface. The optimizer functions by repetitively executing the simulation with slight modification to one or more parameters during each execution thereof, i.e., the optimizer uses a recursive parameter optimization process. The user specifies which parameters are held constant (locked) and which are to be optimized. With each modification of the optimizable parameters, the simulation attempts to achieve the specified criterion for ending the simulation.

Furthermore, the simulator and optimizer are designed to operate in conjunction with an actual CMP system such that the initial parameters used by the simulation are parameters measured by the CMP system hardware. These initial parameters are then optimized to meet a criterion such as polishing non-uniformity across the wafer surface. The optimized parameters are then used by the actual CMP system to polish substrates.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

The invention is a simulator for a chemical mechanical polishing (CMP) system that, given operational parameters defining a CMP system, accurately analyzes the CMP system and predicts the results of substrate polishing using such a CMP system. The simulation can also be optimized such that the initial parameters are updated to achieve optimal CMP system simulation. Optionally, the results of the optimization can be utilized by CMP system hardware to adjust control parameters used to control physical polishing of one or more substrates. As such, the CMP system simulator provides feedback to the CMP hardware of optimized control parameters to facilitate optimal substrate polishing.

Figure 1:
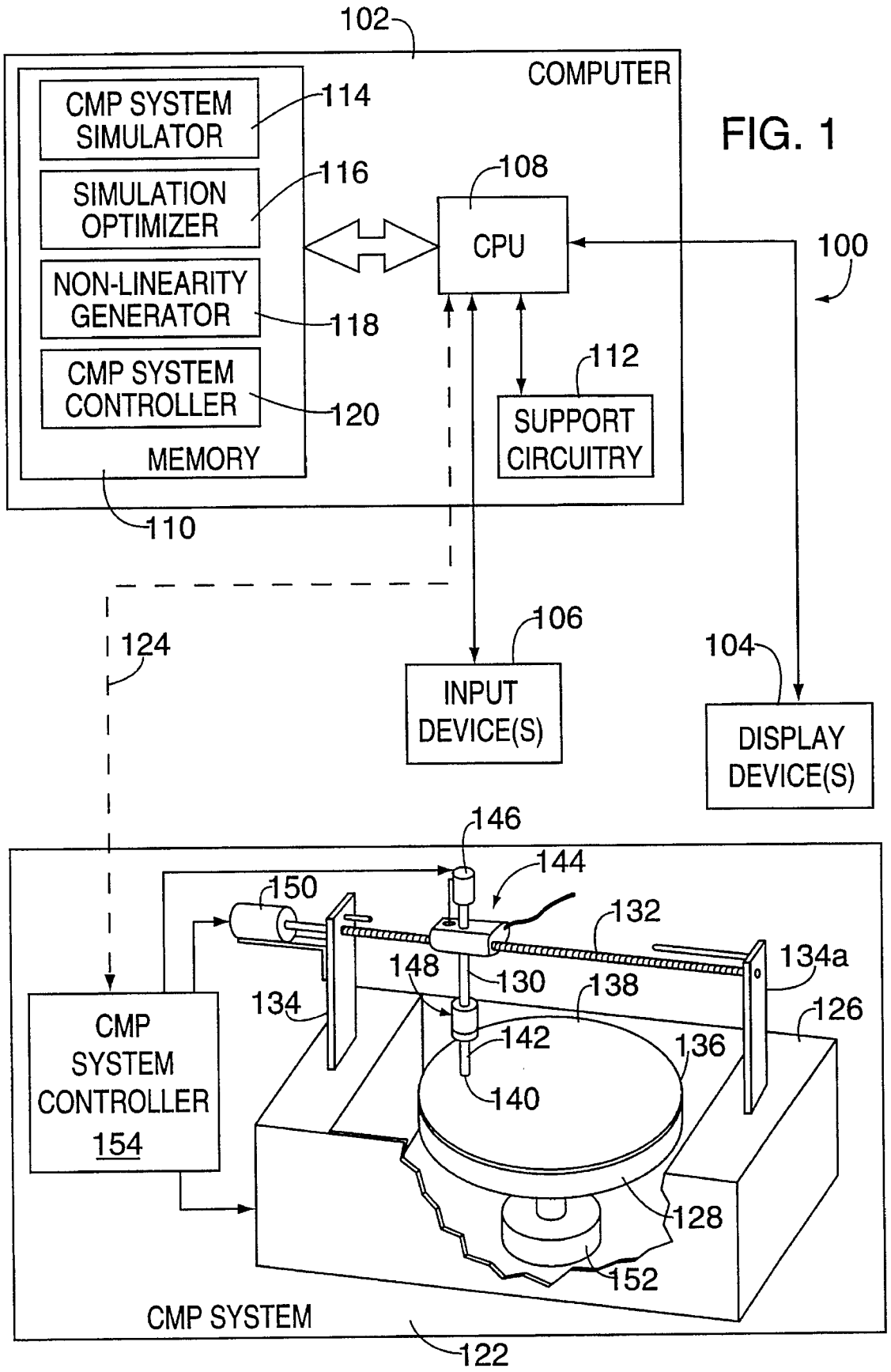
FIG. 1 depicts a block diagram of a general purpose computer system configured for executing a software implementation of the invention.

FIG. 1 depicts a general purpose computer system 100 configured to execute a software implementation of the invention. The system 100 contains a computer 102, one or more display devices 104, and one or more input devices 106. The computer 102 contains a central processing unit (CPU) 108 such as an Intel 486 microprocessor, a memory 110 and assorted support circuitry 112 such as a math co-processor, power supply, and the like. Such computer systems are commonly known as personal computers. The input devices 106 used with such computers include a keyboard, a mouse, trackball and the like. The display devices 104 include computer monitors, printers and plotters.

The memory 110 stores the software implementation of the invention. Specifically, the memory contains a CMP system simulator 114, a simulation optimizer 116, a non-linearity generator 118, and, as an option, a CMP system controller 120. When executed by the CPU 108, the simulator 114 operates as a main routine (routine 500 of FIG. 5) which performs all the simulation tasks and provides output information to the display devices. The optimizer 116 provides specific routines (routine 600 in FIG. 6 and routine 614 in FIG. 7) to optimize the operational parameters used by the simulator 114. The non-linearity generator 118 improves the simulation process by supplying non-linear operational parameters that cause the simulation to function more closely to experimental data. Lastly, when executed by the CPU 108, the CMP system controller 120 (routine 1000 in FIG. 10) provides an optional interface (along dashed line 124 in FIG. 1) to a CMP system 122.

The CMP system 122 could either be a small pad or a large pad system. Illustratively, a small pad system is depicted. The small pad system generally includes a base 126 for rotatably supporting a rotating plate 128 therein, and a moveable tubular polishing arm 130 suspended over the rotating plate 128 and supported on a cross arm 132. The cross arm is maintained on the base and over the plate by opposed uprights 134, 134*a* which extend upwardly from the base. The rotating plate preferably includes a conformable pad fixed to its upper surface. A substrate 136, having an upper surface 138 to be polished, is placed on the conformable pad to maintain the substrate in position beneath the polishing arm as the substrate is polished. The tubular polishing arm 130, with a polishing pad 140 located over the lower open end 142 thereof, is moved generally radially across the upper surface of the substrate to perform the polishing. The polishing pad is preferably continuously moved linearly across the rotating substrate, from the edge to center, until the polishing end point is attained (e.g., a predefined degree of surface non-uniformity).

CMP system controller 154 controls motion of the rotating plate and motion of the polishing arm. Specifically, the control system controls the rotational velocity of motor 152 that is coupled to plate 128. Also, the linear motion is provided by motor 150 coupled to cross arm 132. Linear positioning mechanism 144, under control of the controller 154, controls the pressure of the pad on the substrate surface through a load mechanism 148 and controls the rotation of the pad through motor 146. As such, controller 154 controls all aspects of this small pad CMP polishing system. For a full disclosure of this illustrative small pad CMP system, see commonly assigned U.S. patent application Ser. No. 08/153,331, filed Nov. 16, 1993, entitled "Substrate Polishing Apparatus" and incorporated herein by reference.

The interface 124 of the present invention communicates with the CMP system 122, specifically with CMP system controller 154. Using such an interface between the CMP system hardware and the CMP system simulator, the simulation can utilize initial operational parameters measured by the CMP system hardware, then update those parameters with optimized parameters gleaned from execution of the optimized simulation. Consequently, when the CMP system hardware is used to polish substrates, the physical polishing process is optimized in accordance with the simulation.

As previously mentioned, the simulated CMP system is either a large pad system such as that disclosed in U.S. Pat.

No. 5,234,867 issued Aug. 10, 1993 or a small pad system such as that described in the aforementioned U.S. Patent Application. Both these CMP systems have a number of operational parameters that can be controlled to optimize the polishing process. These parameters include polishing pad size and shape, polishing pad to substrate pressure, polishing pad rotation rate, substrate rotation rate, and duration for which the polishing pad dwells over a specific location on the substrate (dwell time).

The operational parameters that are used in the simulation are similar to those available as variables in the physical CMP system hardware. Specifically, the parameters used by the simulator are rotational velocity of the polishing pad, rotational velocity of the substrate, polishing pad size and shape, dwell time of the polishing pad over a particular portion of the substrate, and a number of passes of the polishing pad over the substrate (or substrate over the polishing pad). Each of these parameters can be manually defined by a user and the simulation determines the resulting non-uniformity of the polished substrate. Alternatively, one or more of the parameters can remain a variable for optimization. The optimization routine then optimizes the variable parameter(s) to achieve a predefined degree of uniformity (or non-uniformity). Also as an alternative, the initial parameters for the optimization can be loaded directly from a CMP system or from a computer file, then the simulation optimization process determines updated parameters that, when used by the CMP system hardware, achieve a predetermined degree of polishing non-uniformity.

Figure 2:
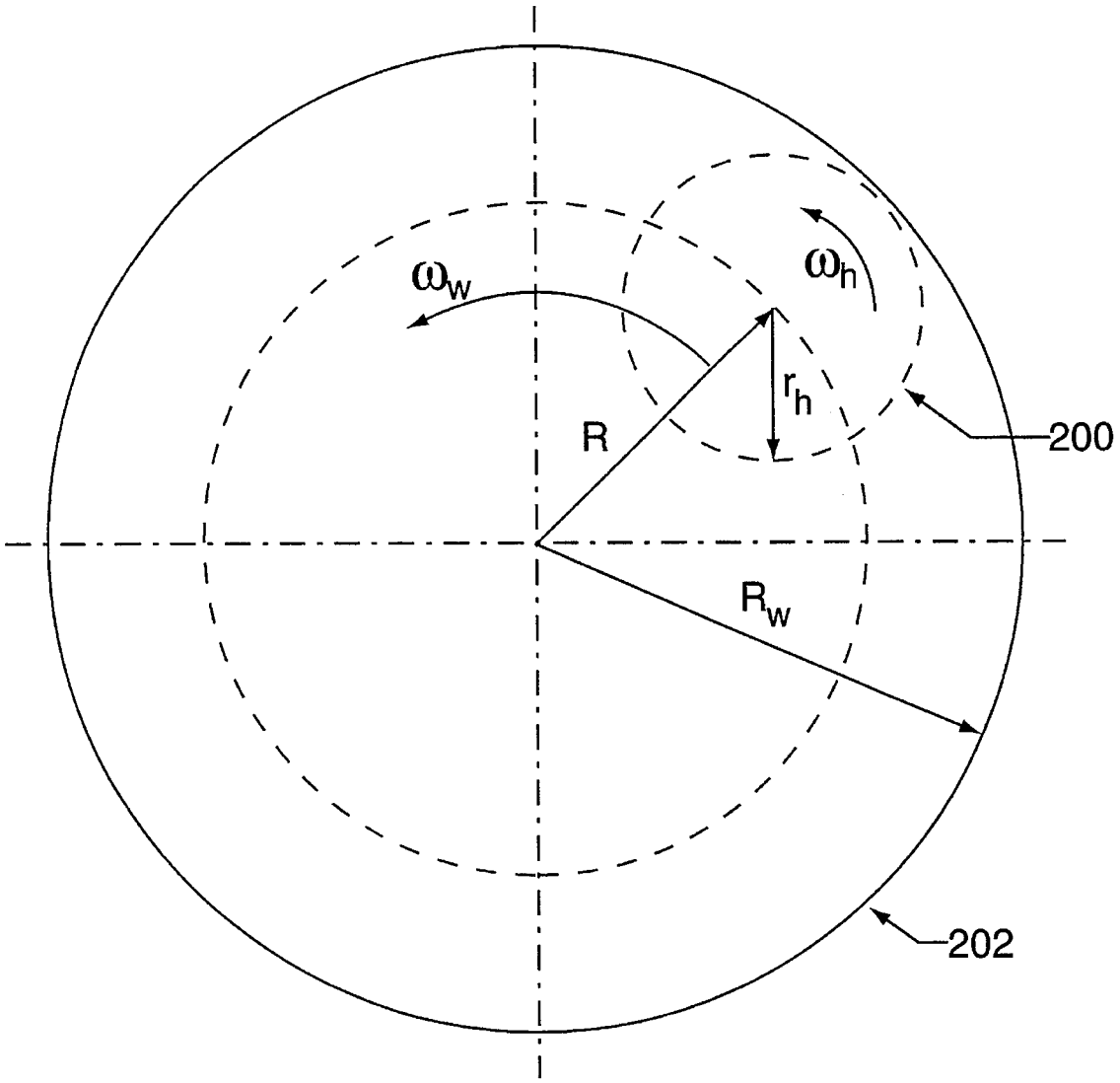
FIG. 2 depicts the relative movement of a polishing pad with respect to a substrate in a small pad CMP system.

Before specifically describing the simulation routine used to implement the simulator 114, it is necessary to discuss assumptions used by the routine and the structure (model) of the simulated CMP system. FIG. 2 depicts a model of a CMP system. This particular model is a small pad type CMP system having a polishing pad 200 with a radius $r_h$ operating upon a substrate 202 with a radius $R_w$. The polishing pad 200 rotates with an angular velocity $\omega_h$ and the angular velocity of the polishing pad relative to the substrate is $-\omega_w$. The variable R is the radial position of the polishing pad relative to the center of the substrate. The simulation uses the substrate as a reference frame. As such, although both the substrate and the polishing pad are rotating, the polishing pad, relative to the substrate, orbits about the substrate center at angular velocity $\omega_w$.

Figure 9:
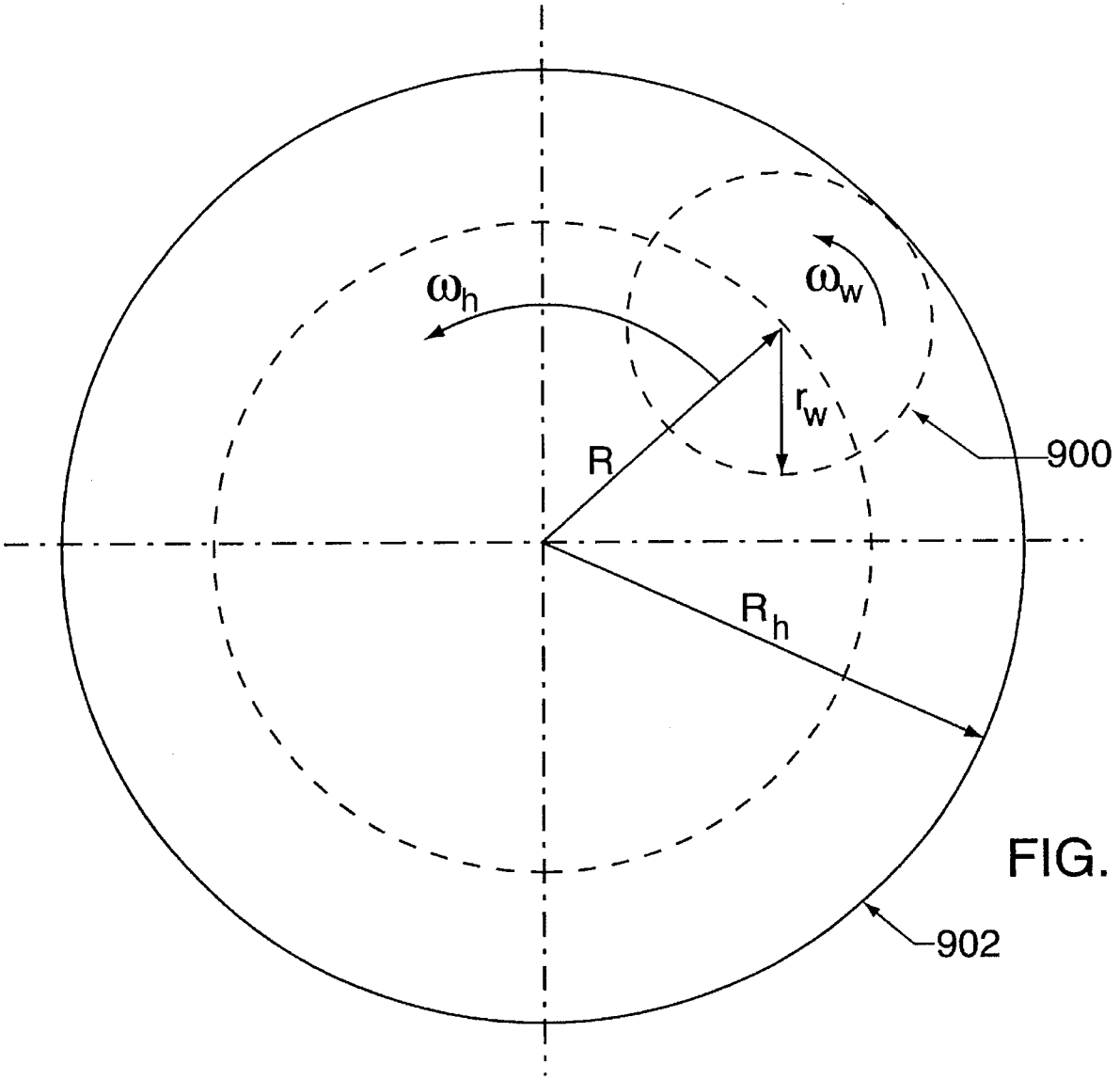
FIG. 9 depicts the relative movement of a polishing pad with respect to a substrate that is used in the simulation of a large pad CMP system.

When the simulator is used to simulate a large pad CMP system, the model shown in FIG. 2 is still utilized; however, the variables discussed above are interchanged. Specifically, as shown in FIG. 9, the large pad polishing pad 902 has a radius $R_h$ operating upon a substrate 900 with a radius $r_w$, i.e., the polishing pad is larger than the substrate. Furthermore, the polishing pad rotates with an angular velocity $-\omega_h$ hand the angular velocity of the polishing pad relative to the substrate is $\omega_w$. The variable R is the radial position of the substrate relative to the center of the polishing pad. As with the small pad system simulation, this simulation uses the substrate as a reference frame. As such, although both the substrate and the polishing pad are rotating, the polishing pad, in essence, orbits about the substrate center at angular velocity $\omega_w$.

Since the mechanics of the simulation are the same for either a simulation of a small pad system or a large pad system, the following discussion refers to a simulation of a small pad system (depicted in FIG. 2). Those skilled in the art should understand that the routines described below apply to both a large pad system and a small pad system, except that the variables are interchanged in the manner discussed above with reference to FIGS. 2 and 9.

Figure 3:
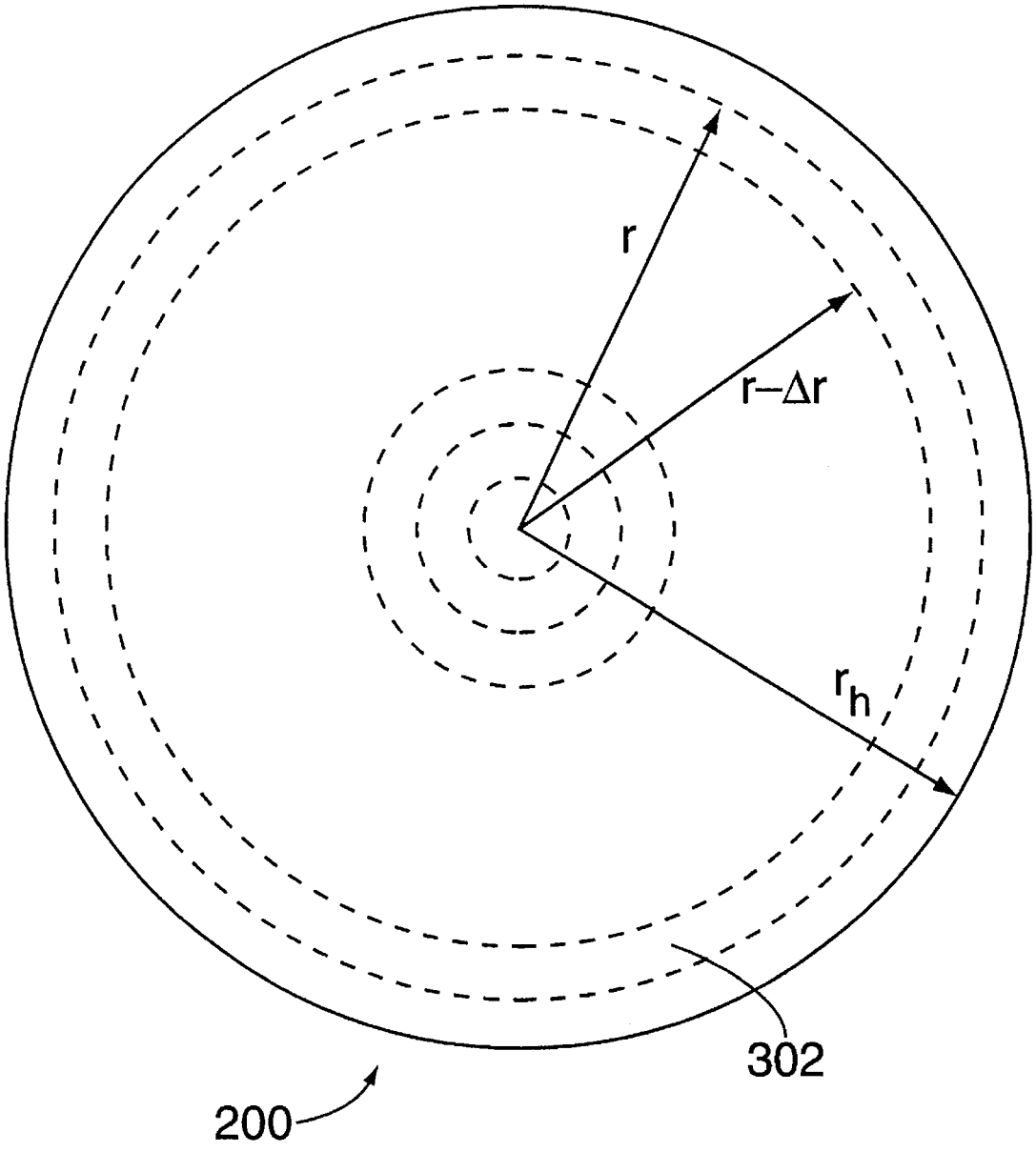
FIG. 3 depicts a model of a polishing pad in CMP system used by the simulation.

FIG. 3 depicts a model of the polishing pad 200 (or 902). To define the amount of the surface area of the polishing pad that is used in polishing, the simulation uses a polishing pad "fill factor". The fill factor is generally defined as a percentage of available pad surface area that is used in the polishing process. To model the fill factor, the polishing pad is divided into NR concentric rings 302 (e.g., NR in a small pad system model is typically fifteen(15)) and each ring 302 has a width of $\Delta r$ (e.g., $\Delta r=r_h/NR$). Typically, to facilitate an accurate model, more rings 302 are used in a model of a large pad than a model of a small pad. More specifically, the fill factor, for purposes of the simulation, is the fraction of available pad surface area within any one ring 302 that is used in the polishing process.

Figure 4:
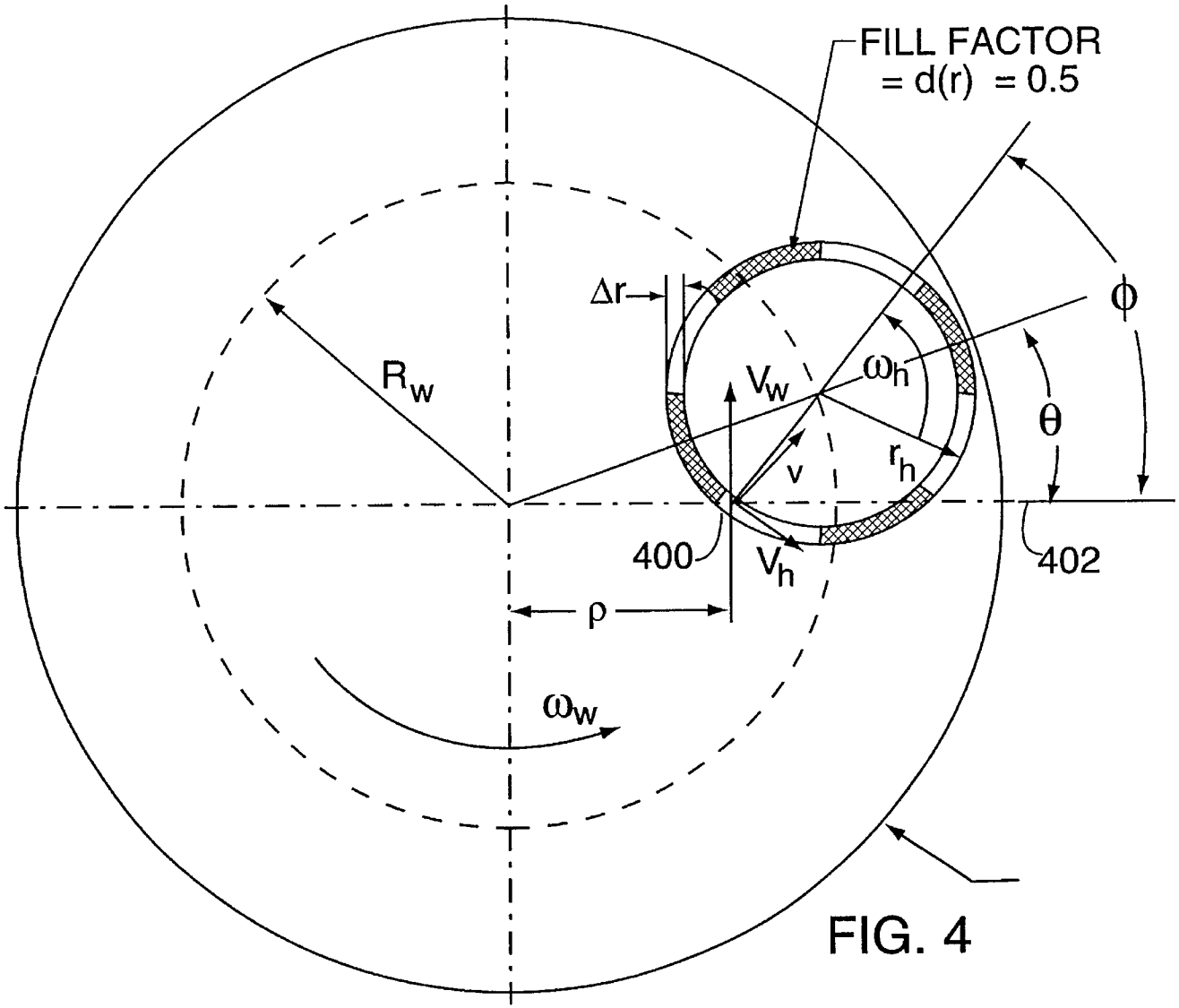
FIG. 4 depicts a model of a polishing pad and a substrate that is used in the simulation of a small pad CMP system.

As further shown in FIG. 4, each ring is assigned a fill factor d(r) that indicates the fractional amount (e.g., a number between 0 and 1) of surface area of the polishing pad that participates in the polishing process. In practice, a polishing pad never utilizes all of its surface area to polish a substrate. Typically, there are slurry channels, slurry distribution ports, and the like formed in the surface of the pad. Thus, a practical polishing pad actively utilizes a fractional portion of the entire surface area of the polishing pad. As such, the simulation is capable of using any form or shape of pad. However, for simplicity, at the beginning of a simulation, the fill factor is generally the same for each of the rings. For example, if half of the surface area of each individual ring participates in the polishing process, then the fill factor is 0.5 for all the rings. For simplicity, the actively utilized portion of the pad is distributed evenly about the surface area of the pad, e.g., in equally sized pie-shaped elements. However, the simulation may use any distribution of actively used surface area.

During the simulation, the polishing pad is moved in discrete steps across the substrate from zero radius to radial distance $R_{MAX}$ (typically, $R_w=0$ to $R_w=R_{MAX}$). The duration that the pad dwells at a specific radial position $R_w$ is defined as the dwell time D(R). There are NR+1 discrete radial steps of distance $\Delta R$ ($\Delta R=R_{MAX}/NR$). The simulation neglects the time required to move from one radial position to the next. Although in the present simulation implementation the polishing pad is radially moved in discrete steps, it is foreseeable that the polishing pad could be simulated as moving with a non-linear, but continuous motion.

Another assumption used in the simulation is that there is no correlation between the substrate rotation and the polishing pad rotation. As such, while the polishing pad dwells at any given substrate radius $R_w$, it is assumed that all positions on the substrate are exposed to substantially all possible orientations of the polishing pad.

Figure 5:
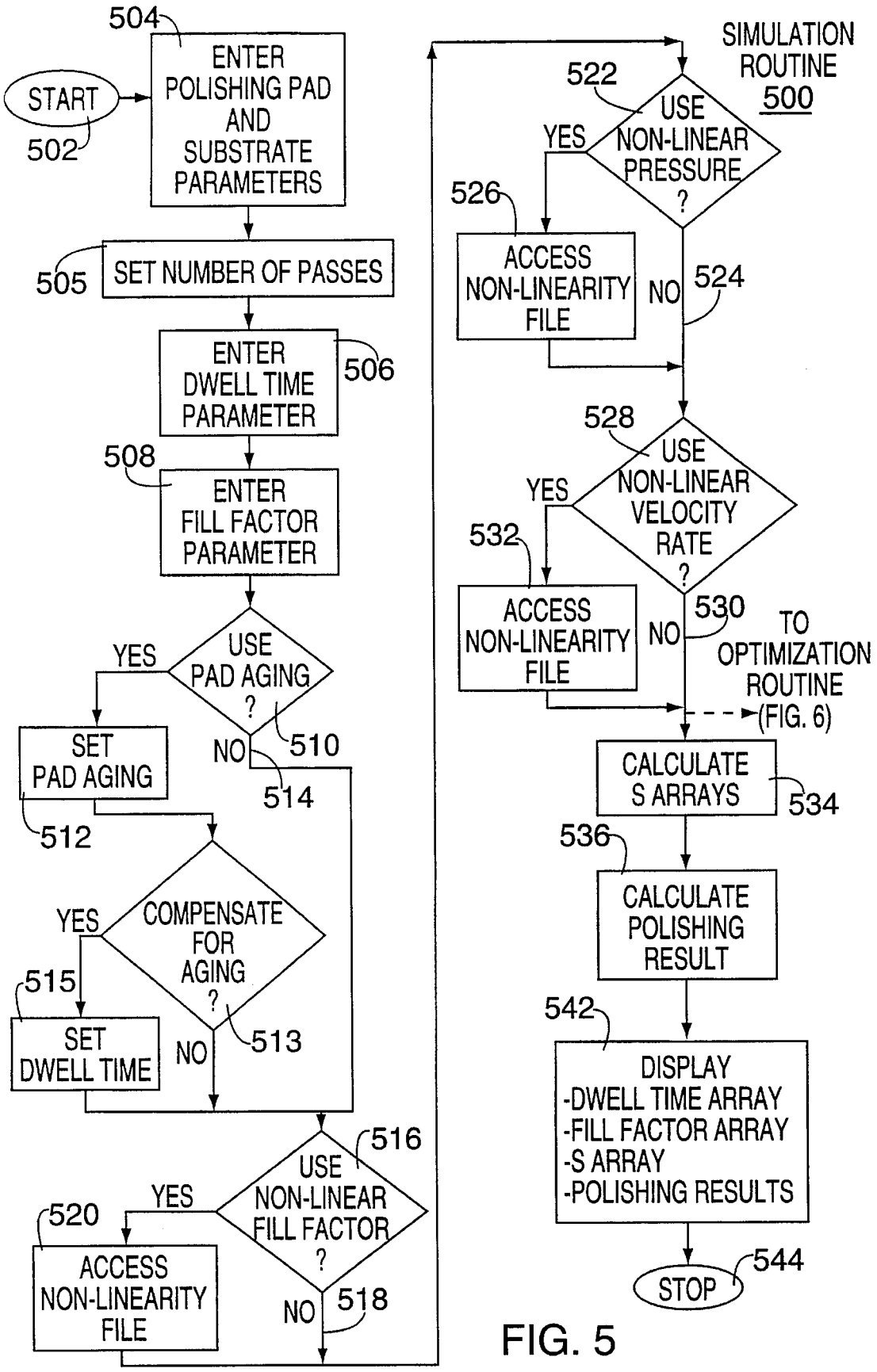
FIG. 5 depicts a flow chart of a CMP system simulation routine.

FIG. 5 depicts a flow chart of a CMP system simulation routine 500 that is used to implement the simulator 114. The routine accepts operational parameter values from a user and uses those parameters in the CMP system simulation routine to predict polishing non-uniformity of a CMP system.

Routine 500 begins at step 502 and proceeds to step 504. At step 504, the user enters the polishing pad and substrate parameters. These parameters include the substrate diameter $2R_w$, the maximum radial position for the polishing pad relative to the substrate rotational axis $R_{MAX}$, the polishing pad radius $R_h$, and the angular velocities of both the polishing pad $\omega_h$ and the substrate $\omega_w$.

At step 505, the user enters the number of passes across the wafer that the polishing pad is to accomplish during the simulation.

At step 506, the user enters the dwell time parameter, e.g., the total polishing time. This parameter is then divided by the number of passes entered in step 505 and the number of substrate zones NR having a zone width ΔR such that the simulation determines a dwell time in each zone. At step 508, the user recalls a fill factor data file from memory. Typically, a plurality of fill factor files are available. These data files contain fill factor data for both fictional polishing pads and for various shapes of polishing pads that are readily available for use in an actual CMP system.

Figure 11:
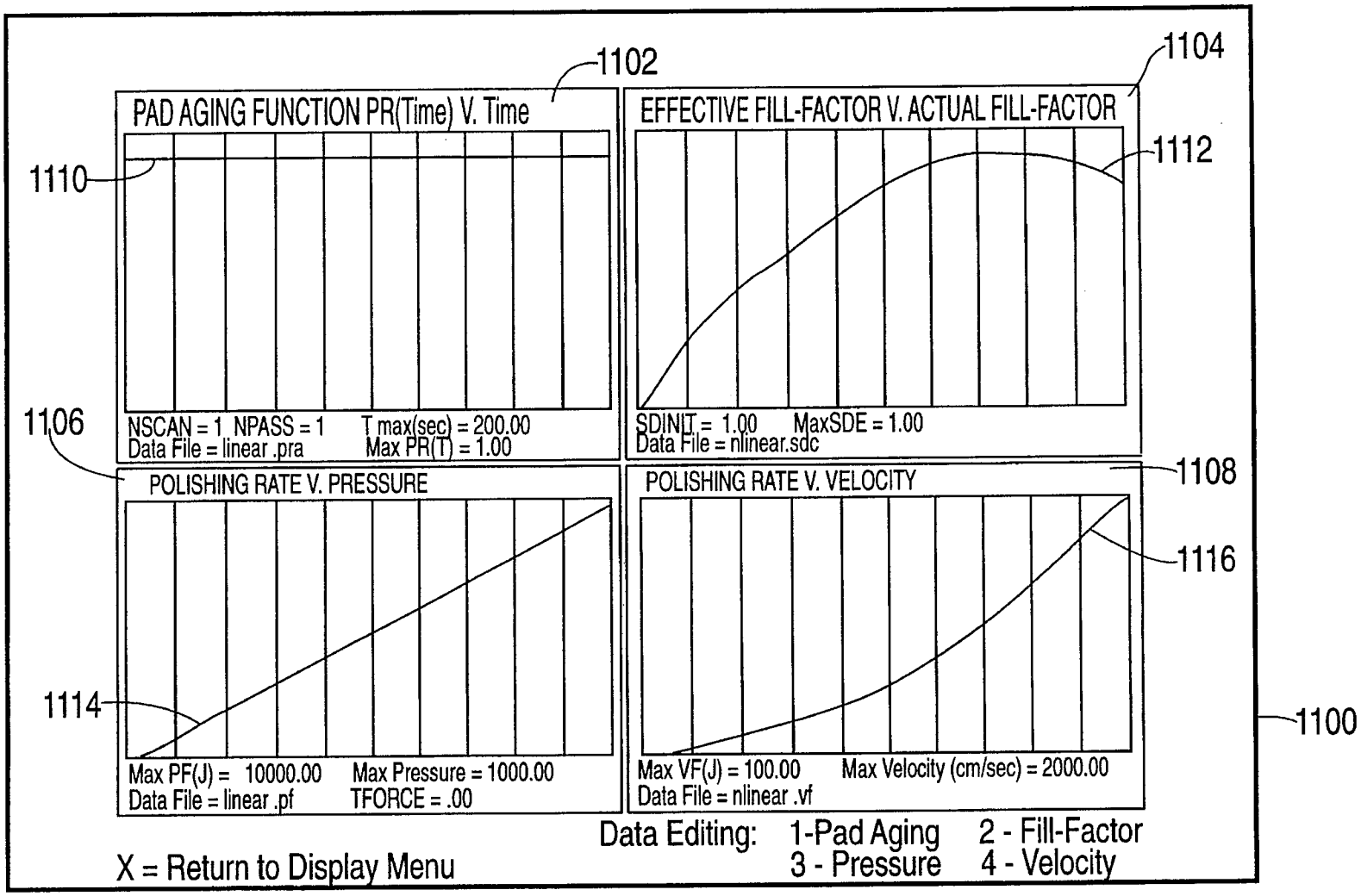
FIG. 11 depicts an illustrative display of non-linear parameters available for use in the simulation routine of FIG. 5.

To produce a realistic simulation, the routine 500 executes a number of steps that enable a user to elect whether certain parameters are non-linear parameters. In particular, in steps 510, 516, 522, and 528, the user is respectively queried whether non-linear pad aging, fill factor, pressure, and velocity rate should be used. The system, when requested, displays a four quadrant display, where each quadrant displays the parameter function (linear or non-linear) to be used in the simulation. FIG. 11 depicts such a display 1100. Quadrant 1102 depicts a graph 1110 of the pad aging function versus time, quadrant 1104 depicts a graph 1112 of the effective fill factor versus the fill factor, quadrant 1106 depicts a graph 1114 of the polishing rate versus pressure, and quadrant 1108 depicts a graph 1116 of the polishing rate versus velocity. Each of these parameters are discussed in detail below.

At step 510, the routine queries whether the user desires the simulation to incorporate pad aging. If the user affirmatively answers the query, the routine sets, at step 512, the pad aging parameters. These parameters alter the effectiveness of the polishing pad at material removal as a function of total material removed. In other words, the longer the polishing pad is used to polish the substrate, the amount of material removed over a given period of time (the "polishing rate") generally decreases. The simulation produces pad aging by decreasing the polishing rate in accordance with the duration that a pad has been used (the "age" of the pad). Typically, the aging data is stored as an array within the memory and the routine recalls, as needed, an array value of the polishing rate corresponding to the duration that the pad has been used. For example, at the beginning of a simulation, the aging factor is set to 1.0 such that the pad is fully effective in polishing the substrate. However, as the polishing pad ages, the simulation reduces the effective polishing rate by recalling, from the aging data array, particular polishing rate values that are less than 1.0 (e.g., these values, taken together, define a decay function). As such, the simulation results in the pad being less effective at removing substrate material over time. Typically, the values of the aging data array are empirically determined by measuring polishing rate degradation as an actual CMP system is used. If the user elects not to implement pad aging, then the routine proceeds along path 514 to step 516. FIG. 11 depicts, in quadrant 1102, a graph 1110 of a linear pad aging function versus time.

Once pad aging is selected, at step 513, the routine queries whether the user desires to compensate for pad aging. To compensate for the aging effect, the simulation increases the dwell time at each radial position R. This method of aging compensation is exactly the same method that is used in an actual CMP system. If aging compensation is selected, the routine adjusts, at step 515, the dwell times that were previously established in step 506. If compensation is not desired, step 515 is not executed and the routine proceeds to step 516.

At step 516, the user selects whether the simulation should use a non-linear fill factor. The fill factor non-linearity corrects for uneven slurry distribution effects which tend to make the effective fill factor for a given ring 302 of the polishing pad 200 (see FIG. 3) unequal to the actual physical fill factor, i.e., in the real world, doubling the amount of pad material within a ring may not exactly double an amount of polishing accomplished by that ring. Consequently, the fill factor is non-linearly related to polishing rate to form an effective fill factor. If the user affirmatively answers the query of step 516 in FIG. 5, the routine sets, at step 520, the non-linear fill factor parameters. The non-linear fill factor parameters are stored in a fill factor file such that, by entering the file name, the routine retrieves the non-linear fill factor parameters. These non-linear parameters form a look-up table in which are stored polishing rate values for each ring NR in the polishing pad. FIG. 11 depicts, in quadrant 1104, a graph 1112 of a non-linear relationship between effective fill factor and fill factor.

If fill factor non-linearities are not desired, the routine proceeds along path 518 to step 522. As such, the fill factor is assumed to be linear, i.e., the polishing rate for each ring of the polishing pad is proportional to its fill factor.

Typically, the polishing rate is assumed to be proportional to the pressure between the pad and the substrate. As such, the relationship between the polishing rate and pressure is said to form a "polishing rate pressure linearity." In some instances, this assumption is not true. Therefore, the simulation enables the user to elect to utilize a non-linear polishing rate pressure relationship. As such, at step 522, the routine queries whether the simulation should utilize a non-linear pressure. If the query is answered affirmatively, the routine sets, at step 526, the non-linear parameters. These parameters are stored in a computer file and are used by the simulation as a look up table having particular pressure values correlated with specific polishing rates. If the user selects not to use non-linear pressure, then the routine proceeds along path 524 to step 528. FIG. 11 depicts, in quadrant 1106, a graph 1114 of a linear relationship between polishing rate and pressure.

Furthermore, the polishing rate is generally assumed to be proportional to the local relative velocity between the rotating pad and the rotating substrate. This relationship is referred to as the polishing rate velocity linearity. However, in some instances, this assumption is incorrect. As such, at step 528, the routine queries whether the user desires the simulation to use a non-linear polishing rate velocity relationship. If the query is affirmatively answered, the routine sets, at step 532, the non-linear parameters. These parameters form a look-up table that correlates polishing rate values with relative velocity values. If the user does not desire a non-linear polishing rate-velocity profile, the routine proceeds along path 530 to step 534. FIG. 11 depicts, in quadrant 1108, a graph 1116 of a non-linear polishing rate-velocity profile.

At step 534, the routine calculates an S array using the parameters that were previously selected and/or defined. The S array is a series of two-dimensional arrays in the values of R and r. There is one S array for each value of parameter ρ (a given substrate radial position). The values in the S array are indicative of the amount of material removed from the substrate for a given radial position on the substrate.

The calculation of the S array is best described in relation to FIG. 4. The velocity v of an arbitrary point 400 on the polishing pad that lies along the x-axis 402 is a resultant of two velocity vectors:

$v_w$=velocity at a substrate radius ρ due solely to the substrate rotation;

$v_h$=velocity at a substrate radius ρ due solely to the pad rotation.

The resultant velocity v of a given point on the polishing pad in contact with the substrate at radius ρ is then the vector sum of the two component velocity vectors:

$$v=v_w+v_h \tag{1}$$

Assuming that at time t=0, the center of the polishing pad is aligned with the x-axis. Then at time t>0, the center of the polishing pad forms an angle θ with respect to the x-axis 402. As such, $\theta=\omega_w t$. The position of the center of the polishing pad is:

$$x_w=R\cos\omega_w t \tag{2}$$

$$y_w=R\sin\omega_w t \tag{3}$$

As such, the velocity components are:

$$v_{WX}=R'\cos\omega_w t-R\omega_w\sin\omega_w t\cong-R\omega_w\sin\omega_w t \tag{4}$$

$$v_{WY}=R'\sin\omega_W t+R\omega_W\cos\omega_W t\cong R\omega_W\cos\omega_W t \tag{5}$$

where, R'=radial velocity of the polishing pad $<<R\omega_W$.

This assumption for R' is obviously incorrect when R=0, i.e., when the polishing pad is positioned at the center of the substrate. In practice, the polishing pad is not positioned at the substrate center or is only positioned there for a short period of time, e.g., D(R)≅0. Consequently, the amount of error introduced into the simulation result by this approximation is negligible. The velocity components due solely to the rotation of the polishing pad are:

$$v_{hx}=+r\omega_h\sin\phi \tag{6}$$

$$v_{hy}=-r\omega_h\cos\phi \tag{7}$$

where φ is the angle between the center of the polishing pad and the point 400 where a given polishing pad ring is coincident with the x-axis.

Using conventional trigonometric formulae, the values of R, r, ρ, θ, and φ can be related as follows:

$$r^2=R^2+\rho^2-2\rho r\cos\theta \tag{8}$$

$$R\sin\theta=r\sin\phi \tag{9}$$

Given R, r and θ, Equation 8 is used to calculate ρ. Then Equation 9 is used to compute φ. Thereafter, the velocity components of the polishing pad can be computed as:

$$v_x=-R\omega_W\sin\omega_W t+r\omega_h\sin\phi \tag{10}$$

$$v_y=R\omega_W\cos\omega_w t-r\omega_h\cos\phi \tag{11}$$

The velocity values are calculated over a range of θ. The range is defined as $\pm\theta_{MAX}$. The value $\theta_{MAX}$ is defined as the angle θ when the polishing pad outer edge is coincident with the x-axis, e.g., the angle θ at a distance $r_h$ from the x-axis.

Consequently, the S array for all incremental values of R, r and ρ is:

$$S(\rho;R,r)<=S(\rho;R,r)+K[v_x^2+v_y^2]^{1/2} \tag{12}$$

As such, the previously calculated value of S is added to the polishing rate to determine a new value of S. The polishing rate is the velocity vector multiplied by a conversion factor K. The conversion factor is generally a constant. Each value of S is stored in a two-dimensional array for a given value of ρ. The value of S represents the amount of material removed over the range of $\pm\theta_{MAX}$. There is no need to calculate points on the substrate outside of this range, because the symmetrical nature of the simulation would merely generate the same result for each radius of the substrate.

At step 536, the values in the S array are used to calculate the polishing result as a function of substrate radius ρ by combining the S array values (S) with the dwell time array values (D) and the fill factor array values (d) as follows:

$$P(\rho)=\sum_{R=0}^{R_{MAX}}\sum_{r=0}^{r_h}D(R)\cdot S(\rho;R,r;\omega_W,\omega_h)\cdot d(r) \tag{13}$$

The first summation is accomplished over r ranging from 0 to $r_h$ in increments of Δr and the second summation is accomplished over R ranging from 0 to $R_{MAX}$ in increments of ΔR. The result is a polishing result (P) at a particular radius (ρ) on the substrate.

At step 542, one or more displays are generated. Typically, the displays include a dwell time array D(R) that depicts the amount of time the polishing pad dwells in each zone, a fill factor array d(r) depiction that shows the fill factor for each ring of the polishing pad, and a polishing result graph that shows the polishing result values P versus substrate radius ρ.

At step 544, the CMP simulation routine 500 stops. In this manner, the routine computes and displays information that indicates the non-uniformity of the polishing process after one or more passes of the polishing pad over the substrate.

The foregoing simulation assumes that a support ring, typically fabricated of hard plastic, circumscribes the substrate. As such, as the polishing pad polishes near the edge of the substrate and the pad overhangs the substrate edge, the pressure of the polishing pad on the substrate will remain constant, i.e., the support ring together with the substrate support the polishing pad. Alternatively, if a support ring is not assumed to support the polishing pad, the simulation increases the polishing rate in response to an increased pressure on the smaller area of the substrate that is now contacting the polishing pad. As more pad overhang occurs, the pressure between the pad and the substrate increases and, proportionally, the polishing rate increases. As such, during a given time period, more material is removed from the substrate as a greater amount of the pad overhangs the substrate. To accurately simulate this phenomenon, the dwell time is increased in the substrate zones near the edge of the substrate such that the simulation removes an increased amount of material as the polishing pad overhangs the substrate edge. The simulation compensates for this phenomenon by either reducing the pad to substrate pressure as the pad overhangs the substrate or reducing the dwell time for substrate zones near the substrate edge. Thus, compensated results would be similar to the results achieved when assuming that a support ring circumscribes the substrate.

Figure 6:
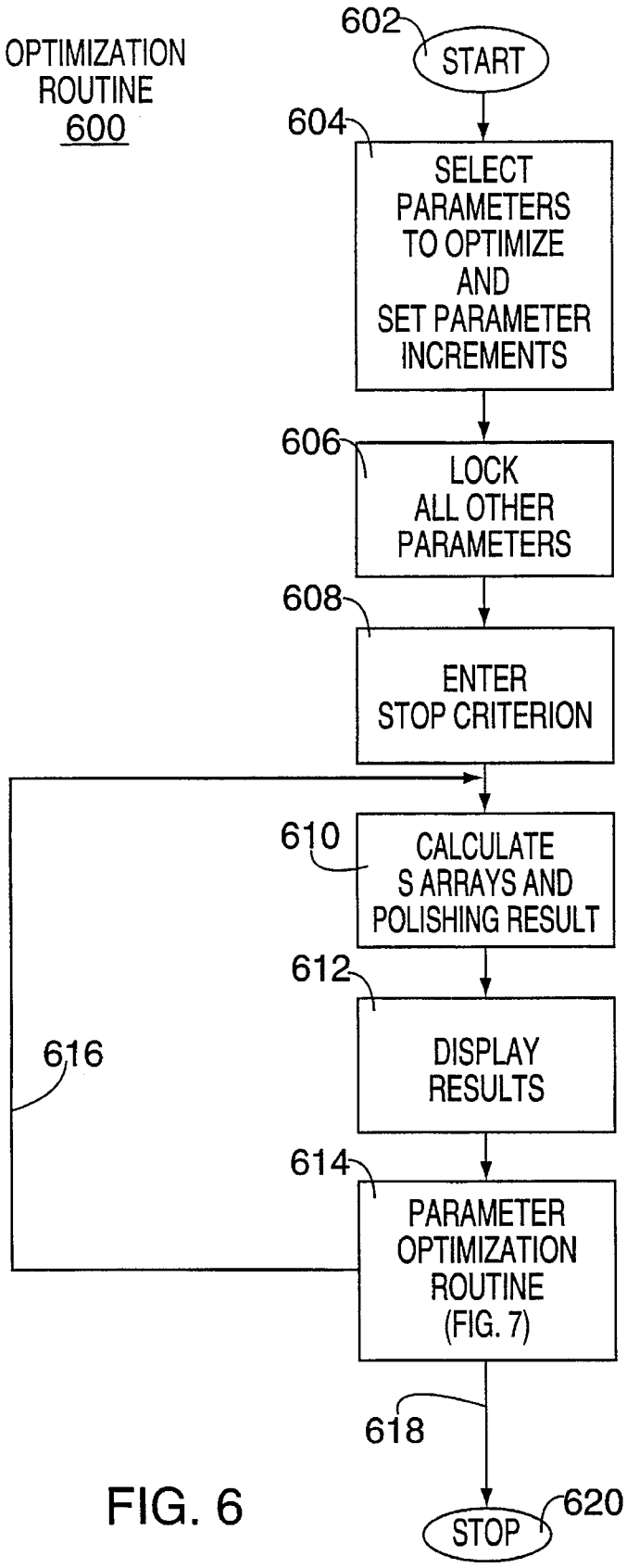
FIG. 6 depicts a flow chart of a CMP system optimization routine as a subroutine of the simulation routine shown in FIG. 5.

FIG. 6 depicts a flow chart of an optimization routine 600 as an illustrative implementation of optimizer 116. Routine 600 judiciously varies selected simulation parameters to achieve a predefined degree of polishing non-uniformity across the substrate. This routine is entered from the simulation routine 500 at a point in routine 500 after step 528. If optimization is desired, from step 528, routine 500 branches into routine 600.

Specifically, the optimization routine 600 starts at step 602 and proceeds to step 604. At step 604, the routine queries a user to select parameters that are to be varied in the optimization process. For each selected parameter, the routine sets an optimization increment, i.e., an initial increment for which a parameter is increased or decreased to achieve optimization. The unselected parameters are "locked", at step 606, to the values that were entered during execution of the simulation routine 500. Typically, the parameters that are varied during the optimization process are the dwell time array values, the fill factor array values, or both. At step 608, the routine queries the user for an optimization stop criterion. Typically, this criterion is a specified degree of non-uniformity across the radius of the substrate as characterized by a standard deviation value, a specified number of optimization cycles, or both. At step 610, the routine calculates the S array and the polishing results P(ρ) as described above with regard to steps 534 and 536 of FIG. 5. At step 612 of FIG. 6, the routine displays the polishing results data as well as other data such as the dwell time array, the fill factor array, and the like.

At step 614, the routine optimizes the parameters by analyzing whether the results of the simulation have met the stop criterion, e.g., have the polishing result values achieved a standard deviation that is less than a particular non-uniformity threshold. If the query is negatively answered, then the routine alters various ones of the parameters and proceeds along path 616 to step 610. At step 610, the routine recalculates the simulation results using the updated parameters. The routine continues executing this optimization loop until the polishing results meet the optimization criterion.

At step 614, the routine also updates the selected parameters in a manner toward achieving the polishing non-uniformity goal. The search routine for optimizing the parameters is a multi-dimensional search routine, e.g., up to thirty dimensions in the multiple arrays. There are many processes available in the art for effectively searching multiple dimensions to achieve an optimal set of parameters. The discussion below with respect to FIG. 7 discloses an illustrative recursive process.

If the query of step 614 is affirmatively answered, e.g., the stop criterion is met, the routine proceeds to step 618 and stops. At this point the selected variables have been optimized and the final simulation results are displayed on the display.

Figure 7:
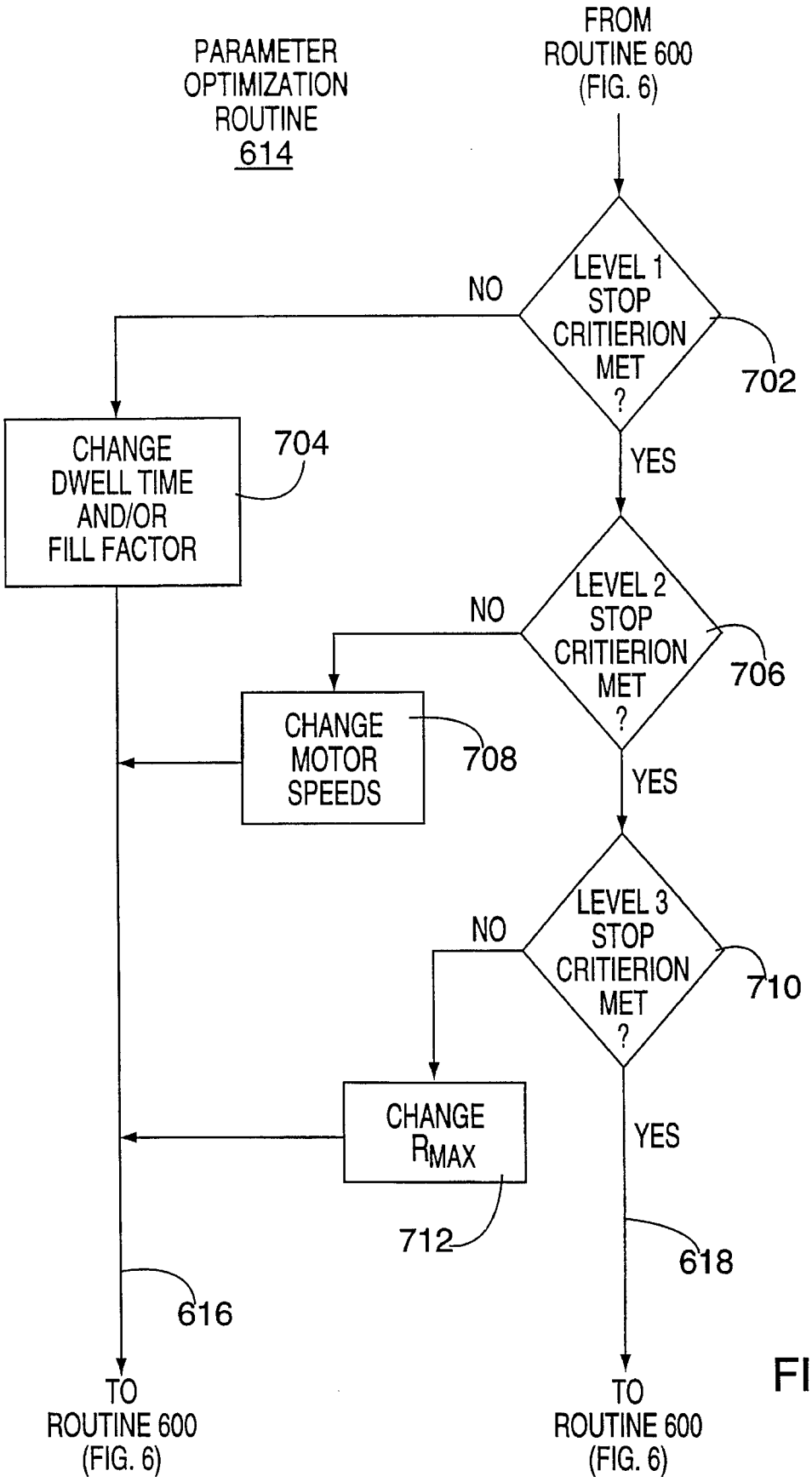
FIG. 7 depicts a flow chart of a multi-dimensional parameter optimization routine.

FIG. 7 depicts a flow chart of a multi-dimensional search routine for determining an optimal set of parameters for the simulation. This illustrative optimization process operates at multiple levels of optimization. At each level, different parameters are altered and then the simulation is executed to determine simulation results for the new parameters. The latest results are compared to previous results to determine whether an improvement is evident. To illustrate operation of the optimization routine, a simple set of optimization parameters shall be discussed. In the following example, three levels of optimization are shown, where the first level optimizes the dwell time and fill factor values, the second level optimizes the motor speeds and the third level optimizes the maximum radial distance $R_{MAX}$ traversed by the polishing pad relative to the rotational axis of the substrate.

At step 702, routine 700 queries whether the "level 1" stop criteria have been met. The level 1 stop criteria include exceeding a predefined number of optimization iterations or achieving a predefined degree of substrate surface non-uniformity as characterized by the standard deviation of the polishing results. If neither of these criteria is met, the routine proceeds to step 704, where the dwell time and the fill factor array values are altered. The routine alters each of these parameters twice, each is increased and decreased to compute four new standard deviation values. Of these four, the most improved value is selected as the center of the next iteration and the routine is repeated using the dwell time and fill factor values corresponding to the improved standard deviation value. The result is a two-dimensional array of standard deviation values corresponding to incremental changes in both the dwell time and fill factor values. When a pair of parameters are discovered that do not have improved standard deviation results appearing at any full increment, the routine uses half increment parameter value changes to compute new results. When the half increment changes no longer improves the results, a quarter increment is used, and so on, until the routine reaches a preset iteration limit. At that point, the result is checked against the predefined non-uniformity criterion. If the standard deviation result exceeds the desired non-uniformity, then the routine executes next level of optimization.

At step 706, the routine accomplishes a second level of optimization by altering, at step 708, a particular parameter (e.g., rotational speed) and then repeating the level 1 optimization as described above. By recursively applying the level 1 and level 2 optimizations to incrementally altered parameter values, the parameter values generate a standard deviation of the polishing results that converges upon the desired optimization criterion. After the level 1 and level 2 optimizations have exhausted a predefined number of iterations, the routine halves the initial increment used to alter the level 2 parameter and repeats the level 1 and 2 optimization. Level 2 optimization is repeatedly executed until a predefined number of level 2 execution iterations have occurred. Thereafter, the query at step 706 is answered affirmatively, i.e., the number of iterations is exceeded or the desired standard deviation is attained. Thereafter, the routine proceeds to a level 3 optimization at step 710.

At step 710, the routine queries whether the results of the routine have met the predefined degree of flatness or whether a predefined number of level 3 iterations has been complete. If the answer to the query is negative, the routine alters, at step 712, another parameter (e.g., $R_{MAX}$) and then repeats the level 1 and level 2 optimizations. The level 3 optimization is recursively applied until no more improvement is shown in the results, then the initial increment used to alter the level 3 parameter is halved and the level 3 optimization is repeated. When either the standard deviation value meets the criterion of levels 1, 2 and 3 (steps 702, 706, and 710) or a predefined number of optimization cycles through all three levels is exceeded, the routine 614 is exited and the present parameter values are considered the optimized parameters.

Once the parameters are optimized, the optimization routine 700 returns to optimization routine 600 along line 618. During optimization and until all the stop criterion are met, the routine returns along line 616 to routine 600.

This hierarchical optimization routine can be expanded to any number of levels of optimization. As such, the routine can optimize any number of parameters. Thus, the invention provides a flexible method for optimizing one or more parameter values of a CMP system.

Figure 8:
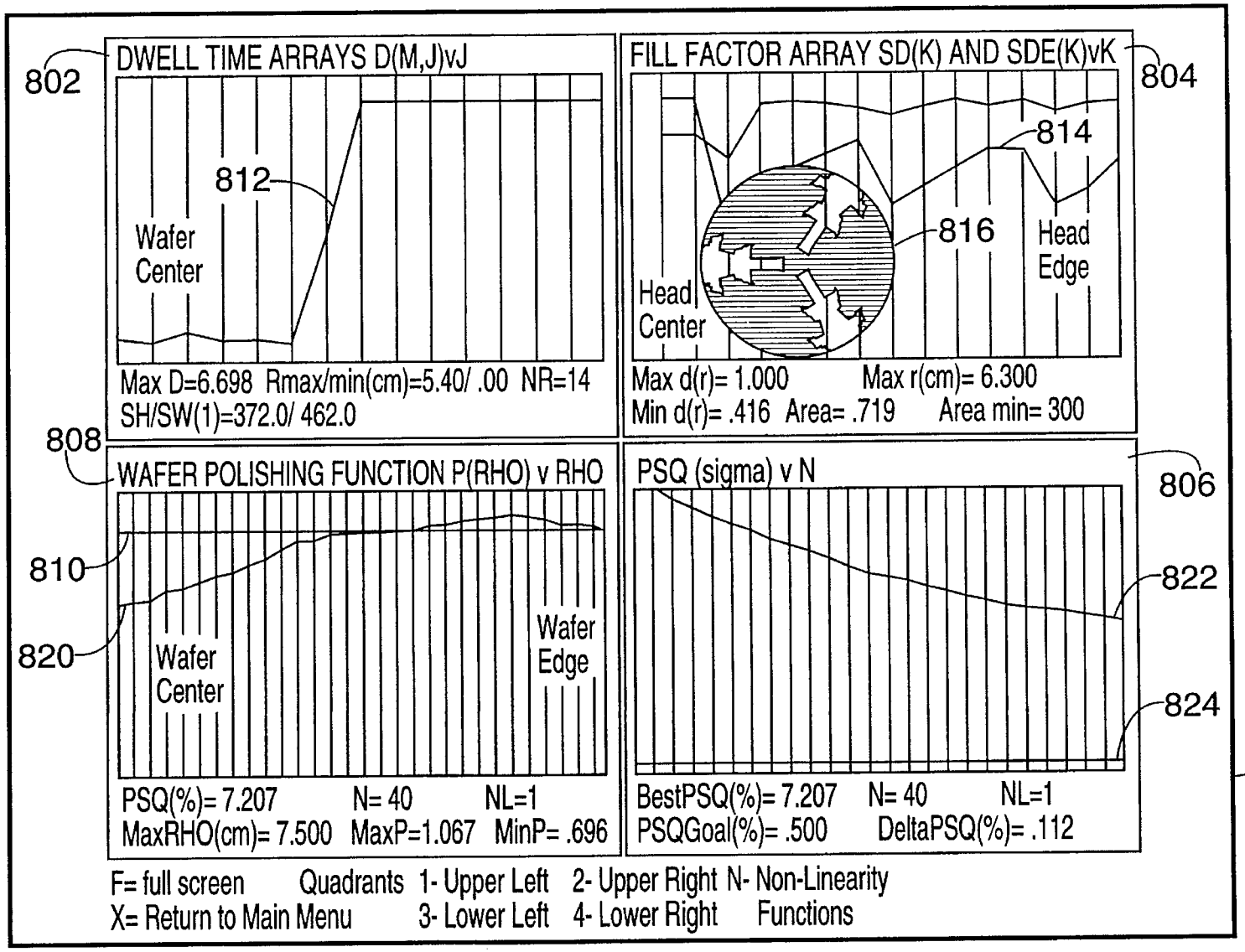
FIG. 8 depicts an illustrative display generated by the optimization routine of FIG. 6.

FIG. 8 depicts an illustrative display 800 of the optimized parameter arrays and the polishing results. Window 802 portrays the optimized dwell time parameter array 812. In window 802, the horizontal axis depicts the number of substrate zones (e.g., fourteen) and the vertical axis indicates an amount of dwell time in each zone.

Window 804 portrays the illustrative fill factor array 814. The horizontal axis represents the number of rings defined to represent the polishing pad and the vertical axis represents the fractional utilization of each ring (i.e., the fill factor of each ring). The two-dimensional circular image 816 represents the fill factor array as it would appear when evenly distributed about a circular polishing pad. The dark portion represents polishing material and the white portions represent open areas.

Window 806 depicts the progress of the optimization process over a number of cycles, e.g., twenty-five cycles. Curve 822 depicts the steady improvement in the polishing non-uniformity (characterized by standard deviation) over a number of cycles. The horizontal line 824 at the bottom of the window represents the non-uniformity goal (e.g., a value for the standard deviation of the polishing results) initially specified by the user.

Window 808 portrays the polishing results 820 across a radial line of a substrate. The horizontal axis represents the radial distance (ρ) from the center of the substrate and the vertical axis represents a degree of polishing. The horizontal reference line 810 extending across the window represents a completely flat surface. As such the polishing result can be easily compared to a perfectly flat reference.

Using the optimization routine and maintaining all variables except the fill factor constant, the simulation can define parameters for an optimal fill factor of the polishing pad. The fill factor is then used to design a physical polishing pad. Alternatively, all variables may be held constant as defined by the constraints of a CMP system except the dwell time and rotation rate, the simulation then may optimize these parameters such that the actual system can be controlled in the optimized manner to achieve optimal polishing results.

Figure 10:
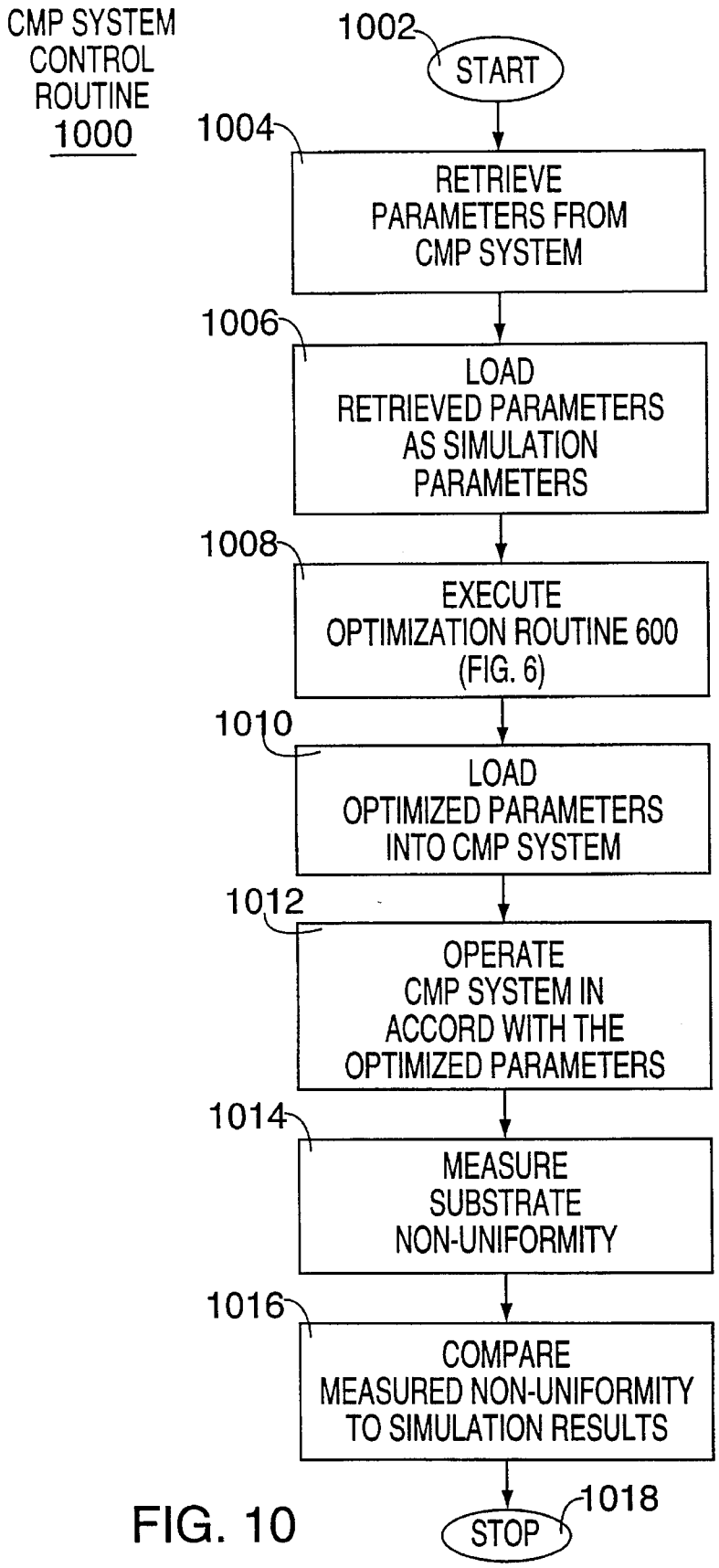
FIG. 10 depicts a flow chart of a CMP system control routine for utilizing control parameters generated by the optimization routine shown in FIG. 6.

FIG. 10 depicts a CMP system control routine 1000 that is used in conjunction with conventional CMP system hardware. In general, the routine retrieves parameters that are measured by the CMP system during substrate polishing. These measured parameters form the starting point for the optimization routine (FIG. 6) to optimize one or more of the captured parameters to attain a deterministic polishing non-uniformity. The optimized parameters are then reloaded into the CMP system to effectuate control of that system. After operation of the system using the optimized parameters, the routine compares the resulting polishing non-uniformity to the simulated non-uniformity.

Specifically, routine 1000 begins at block 1002 and continues to step 1004. At step 1004, the routine retrieves measured parameters from a CMP system. These parameters include the polishing pad surface design (fill factor), pad to substrate pressure, pad and substrate rotation rates, pad and substrate sizes, and dwell times. At step 1006, these measured parameters are loaded into the simulation routine as parameters for the simulation. Other simulation parameters such as non-linearities, pad aging, and the like are defined in this step by a user or are recalled from a predefined computer file. At step 1008, routine 1000 executes the optimization routine of FIG. 6. As such, the captured parameters are used as initial parameters for the optimization and certain parameters are optimized (e.g., dwell time and/or rotation rates). All the parameters that are not optimized are held constant, i.e., these parameters are locked.

At step 1010, the routine loads the optimized parameters into the CMP system. At step 1012, the CMP system is operated in accordance with the optimized parameters as it polishes one or more substrates. At step 1014, the CMP system measures the non-uniformity of the polished substrate(s). At step 1016, the routine compares the measured non-uniformity to the simulated non-uniformity. At step 1018, the routine is stopped.

The comparison is generally utilized to determine whether the parameters should be further altered and/or optimized in an attempt to attain a particular measured non-uniformity. As such, the comparison provides the system user with instantaneous feedback concerning the accuracy of the simulation.

The present invention is apparatus and methods for simulating and optimizing both large pad and small pad CMP systems. Given a number of parameter values for a particular CMP system, the invention permits a user to accurately predict the polishing results that will be achieved by that CMP system. In addition, the invention permits optimization of CMP system parameters to achieve particular polishing results. As such, the invention produces simulation results that eliminate the need for extensive empirical testing of CMP systems to determine the operational parameters for the system that will repeatedly achieve particular polishing results.

Although various embodiments which incorporate the teachings of the present invention have been shown and described in detail herein, those skilled in the art can readily devise many other varied embodiments that still incorporate these teachings.

What is claimed is:

1. A method for simulating a chemical mechanical polishing (CMP) system having a polishing pad, a chuck for supporting a substrate, a positioner for positioning the polishing pad relative to the substrate, a chuck rotator for rotating the chuck, and a polishing pad rotator for rotating the polishing pad, said method comprising the steps of:

(a) defining polishing pad and substrate parameters;

(b) defining simulation parameters;

(c) determining, in response to said polishing pad, substrate and simulation parameters, a polishing result; and (d) displaying said polishing result.

2. The method of claim 1 wherein said step of defining said polishing pad and substrate parameters further comprises the steps of:

defining a radius of said substrate;

defining a plurality of concentric dwell time zones within said substrate;

defining dwell times for each dwell time zone;

defining a polishing pad radius;

defining a plurality of concentric rings within said polishing pad; and defining a fill factor for each ring representing an amount of the polishing pad that participates in polishing the substrate.

3. The method of claim 2 wherein said dwell times are non-linear across the plurality of dwell time zones.

4. The method of claim 2 wherein the fill factor for each ring is non-linear across the plurality of rings.

5. The method of claim 2 further comprising the step of associating a variable polishing rate with each ring of said polishing pad to simulate aging of said polishing pad.

6. The method of claim 5 further comprising the step of altering said dwell times to compensate for said aging.

7. The method of claim 1 further comprising the step of optimizing at least one of said parameters to achieve a predefined optimization criterion.

8. The method of claim 7 wherein said predefined optimization criterion is a standard deviation of said polishing result.

9. The method of claim 7 wherein said optimizing step further comprises the step of executing a recursive, multidimensional optimization process.

10. The method of claim 7 further comprising the steps of retrieving said polishing pad and substrate parameters and said simulation parameters from CMP system hardware and operating said CMP system hardware using at least one of said optimized parameters.

11. The method of claim 1 wherein said CMP system is a small pad CMP system.

12. The method of claim 1 wherein said CMP system is a large pad system.

13. A method for simulating a chemical mechanical polishing (CMP) system having a polishing pad, a chuck for supporting a substrate, a positioner for positioning the polishing pad relative to the substrate, a chuck rotator for rotating the chuck, and a polishing pad rotator for rotating the polishing pad, said method comprising the steps of:

(a) defining polishing pad and substrate parameters;

(b) defining simulation parameters;

(c) determining, in response to said polishing pad, substrate and simulation parameters, a polishing result; and (d) controlling, in response to said polishing result and said simulation parameters, a CMP system.

14. The method of claim 13 wherein said step of defining simulation parameters further comprises the step of retrieving initial simulation parameters from said CMP system.

15. The method of claim 13 wherein said determining step further comprises the steps of varying said simulation parameters and determining, in response to the varied simulation parameters, a polishing result.

16. The method of claim 13 wherein said step of defining simulation parameters further comprises the step of:

defining a plurality of sets of simulation parameters, and wherein said determining step further comprises the steps of:

determining a plurality of polishing results, where each of said polishing results is associated with one of the sets of simulation parameters, and selecting a polishing result and an associated set of simulation parameters used to achieve the selected polishing result from said plurality of polishing results and sets of simulation parameters.

17. The method of claim 16 wherein said controlling step further comprises the step of controlling the CMP system using the selected set of simulation parameters.

18. Apparatus for simulating a chemical mechanical polishing (CMP) system having a polishing pad, a chuck for supporting a substrate, a positioner for positioning the polishing pad relative to the substrate, a chuck rotator for rotating the chuck, and a polishing pad rotator for rotating the polishing pad, said apparatus comprising:

means for defining polishing pad parameters, substrate parameters and simulation parameters;

a processing unit for determining, in response to said polishing pad, substrate and simulation parameters, a polishing result; and means for displaying said polishing result.

19. The apparatus of claim 17 wherein said defining means further comprises:

means for defining a radius of said substrate, a plurality of concentric dwell time zones within said substrate, dwell times for each dwell time zone, a polishing pad radius, a plurality of concentric rings within said polishing pad, and a fill factor for each ring representing an amount of the polishing pad that participates in polishing the substrate.

20. The apparatus of claim 18 wherein said dwell times are non-linear across the plurality of dwell time zones.

21. The apparatus of claim 18 wherein the fill factor for each ring are non-linear across the plurality of rings.

22. The apparatus of claim 18 further comprising means for associating a variable polishing rate with each ring of said polishing pad to simulate aging of said polishing pad.

23. The apparatus of claim 22 further comprising means for altering said dwell times to compensate for said aging.

24. The apparatus of claim 18 further comprising means for optimizing at least one of said parameters to achieve a predefined optimization criterion.

25. The apparatus of claim 24 wherein said predefined optimization criterion is a standard deviation of said polishing results.

26. The apparatus of claim 24 wherein said optimizing means further comprises means for executing a recursive, multi-dimensional optimization process.

27. The apparatus of claim 18 further comprising interface means for retrieving said polishing pad parameters, said substrate parameters and said simulation parameters from CMP system hardware, where said CMP system hardware operates using at least one of said optimized parameters.

28. The apparatus of claim 18 wherein said CMP system is a small pad CMP system.

29. The apparatus of claim 18 wherein said CMP system is a large pad system.

* * * * *